United States Patent [19]

Shidara

[11] Patent Number: 4,736,221

[45] Date of Patent: Apr. 5, 1988

[54] METHOD AND DEVICE FOR PROCESSING PHOTOGRAPHIC FILM USING ATOMIZED LIQUID PROCESSING AGENTS

[75] Inventor: Shinichi Shidara, Tokyo, Japan

[73] Assignee: Fuji Photo Film Co., Ltd., Kanagawa, Japan

[21] Appl. No.: 919,064

[22] Filed: Oct. 15, 1986

[30] Foreign Application Priority Data

| | | | |
|---|---|---|---|
| Oct. 18, 1985 | [JP] | Japan | 60-232864 |
| Oct. 18, 1985 | [JP] | Japan | 60-232865 |
| Oct. 18, 1985 | [JP] | Japan | 60-232866 |
| Oct. 18, 1985 | [JP] | Japan | 60-232867 |

[51] Int. Cl.[4] ..... G03D 5/00

[52] U.S. Cl. ..... 354/317; 354/325; 354/328; 354/339; 134/64 P

[58] Field of Search ..... 354/317, 324, 325, 328, 354/338, 339; 355/27; 134/64 P, 64 R, 122 P

[56] References Cited

U.S. PATENT DOCUMENTS

| | | | |
|---|---|---|---|
| 3,668,905 | 6/1972 | Schlunke | 134/64 R |
| 3,678,841 | 7/1972 | Burke | 354/317 |
| 4,166,689 | 9/1979 | Schausberger et al. | 354/324 |
| 4,327,988 | 5/1982 | Vanhorebeek et al. | 354/324 |
| 4,652,106 | 3/1987 | Jurgensen et al. | 354/325 |

*Primary Examiner*—A. A. Mathews

*Attorney, Agent, or Firm*—Wenderoth, Lind & Ponack

[57] ABSTRACT

Since the prior art photographic film processing methods use a large number of rollers, if the liquid processing agent is adhered an crystallized on such rollers, it often causes uneven processing or damages film surfaces to deteriorate the quality of finished products. Moreover, rollers should be detached from the system for cleaning and maintenance purposes to impose great burden on workers. By omitting rollers for photographic processing, this invention attempts to ovbiate such defects encountered in the prior methods. By atomizing the processing agent, this invention achieves simple adjustment of the density in finished products, uniform processing, less damage on film surfaces and high processing speed.

13 Claims, 8 Drawing Sheets

METHOD AND DEVICE FOR PROCESSING PHOTOGRAPHIC FILM USING ATOMIZED LIQUID PROCESSING AGENTS

BACKGROUND OF THE INVENTION

1. Field of the Invention

This invention relates to a method for continuously processing a photo-sensitive material (which will be referred to simply as "photographic film" hereinafter) in a sheet form such as a sheet of photographic film and a paper by means of liquid processing agents in development. fixation or washing steps and to a device therefor, and more particularly to a photographic film processing method with liquid processing agents such as developer, fixer, or washing water which have been atomized and to a device therefor. This invention further relates to a photographic film processing device which is capable of developing, fixing or washing only the photographically sensitized side of a film sheet with an atomized developer, a fixer, or washing water and of adjusting the scope of the photographic processing in accordance with the size (width) of the film sheet.

2. Description of the Prior Art

FIG. 1 is a cross section to schematically show the structure of a developing device in a photographic film processing system which uses an ordinary roller-conveying processing method wherein a sheet of photographed film 1 is conveyed to the developing device via an inlet 30A by groups of rollers 31A and 31B which are axially and operatively mounted between opposing side plates, where it is developed in liquid developer (D), and developer (D) which is attached to the photographic film 1 with squeeze rollers 31B at the final stage, and then conveyed out via an outlet 30B toward the next step (fixing process).

This roller conveying processing method has been widely used in automatic developing systems, since the method is stable in developing performance and relatively high in processing speed. However, since a large number of rollers are used in the developing device, the liquid developer tends to adhere on the rollers and, once it is coagulated by drying the adhered liquid, causes uneven development or damage to the photographic film 1 thereby deteriorating the quality of the finished product physically as well as aesthetically. Moreover, the rollers should be dismantled for cleaning and other maintenance purposes frequently to thereby impose considerable burdens on workers. Generally, photographic films should be processed only on one surface side of the film sheet (photo-sensitized surface side) except for the film sheets such as X-ray films which need processing on both surfaces. In this method, however, the liquid developer attaches and adheres on both surfaces of a film sheet, inconveniently consuming an additional amount of the developer and requiring additional time for washing the attached developer off as well as drying. The device for the processing method tends to become bulky and complicated. Both the fixing device and the washing device are also generally structured similarly to the above developing device using a roller conveying processing method, and similar defects can be found in the systems for fixing and washing as well as in the photographic film processing systems which continuously use by means of a cascade connection of a developing device, a fixing device and a water washing device.

FIG. 3A shows a camera card 100 which is usually used for microfilms of drawings and so on wherein a sheet of film 101 is fixed on an aperture card 102 one by one. Since the cameria card 100 is fixed on the aperture card 102 but the 102 should not be immersed in the liquid developer or, the above mentioned roller conveying processing method is not applicable for processing such camera cards 100. In order to solve the problem, there has been used a spray processing method shown in FIG. 3B wherein a camera card 100 is tightly held between an upper lid 65 and a body 54 in a manner to mask the aperture card 102 with the body so that the liquid developer or fixer is sprayed from a nozzle 44 attached within the body 54 only onto the surface of the film 101. Since the developer or fixer in this method is jetted from the nozzle 44 via respective pipes 440 and 441, The film 101 is conveniently processed only on one side (sensitized face). However, this method is not completely free of defects as the air tends to mix with the liquid agent while it is being jetted from the nozzle 44 to oxidize it and deteriorate the processing capacity of the liquid agent. This increases the consumption of an agent and, moreover if the shape of the nozzle 44 is not suitable, the developer will not be sprayed evely onto the film 101 to cause uneven development. The procesing liquid tends to coagulate, thereby also clogging the nozzle 44.

FIG. 2A schematically shows a photographic film roll developing device using a straight processing method or an application of the aforementioned spray processing method to a photographic film roll. As shown in FIG. 2B which is a side view, a photographic film 1 is held between rollers 33A and 33B provided at an inlet and an outlet respectively, and is conveyed by rotating the rollers 33A and 33B along guides formed by a body 53 and an upper lid 63 which support both sides of the photographic film 1 so that the developer agent is jetted from a nozzle 43 mounted within the body 53 for developing the photographic film 1. Although the developer which is sprayed from the nozzle 43 is jetted advantageously only onto one surface of the photographic film 1 for development, the air tends to mix in the developer while the developer is being jetted from the nozzle to oxidize it and to deteriorate the processing capacity of the developer. It inconveniently increases the consumption of the agent and if the shape of the nozzle 43 is not suitable, the developer agent cannot be sprayed evenly onto the photographic film 1 to thereby cause uneven development. Further, the developer agent tends to coagulate in the nozzle 43 to clog it. Since the fixing device and the washing device have similar structures to the above and use the aforementioned straight processing method, the similar defects are observed in the fixing and washing as well. Defects similar to the above are also seen in the photographic film processing system which comprises the developing device, the fixing device and the washing device continuously connected and continuously processing.

SUMMARY OF THE INVENTION

This invention was contrived in order to solve the above-mentioned problems encountered in the prior art.

An object of this invention is to provide a photographic film processing method for photographic procesing steps such as developing, fixing and washing which is capable of easily adjusting density in the finished products by menas of a processing liquid agent, achieving even processing, inflicting less damage on the film surface, processing at high speeds, requiring almost no maintenance, thus presenting less burden on workers and consuming a small amount of a processing agent.

Another object of this invention is to provide a device for photographic film processing which can easily adjust density in the finished products, achieve even development, inflict less damage on the film surface, process at a high speed, operate with almost no maintenance and impose less burden on workers and process with a small amount of a processing agent.

Still another object of this invention is to provide a photographic film processing device which can hold film sheets at a width adjusted in accordance with various sizes of film types, can process only one surface of a film sheet which has been photo-sensitized when applied to photographic film processing system, and can process with a small amount of a processing agent.

According to one aspect of this invention, for achieving the objects described above, there is provided a photographic film processing method for processing with liquid processing agents which is characterized in that the liquid processing agent is atomized by an atomizing means, and said photographic film processing is carried out by passing a photographic film through the atomizd agent.

According to another aspect of this invention, there is provided a photographic film processing device for processing photographic film with a liquid processing agent which includes a means for atomizing the liquid processing agent, and a means for guiding the atomized processing agent onto the photo-sensitized surface of the photographic film sheet.

Further, according to still another aspect of this invention, there is provided a photographic film processing device which conducts developing, fixing and washing processes continuously which is characterized in that processing units comprising a means for atomizing liquid processing agents and a guide means for guiding said atomized processing agents onto the photo-sensitized surface of a photographic film sheet are arranged in series to accommodate necessary processing steps and said photographic film is made to pass through said serially connected units for continuous processing of said steps.

Still further, according to another aspect of this invention, there is provided a photographic film processing device for developing, fixing and washing steps including an atomizing means for atomizing a liquid processing agent and a processing section which is adapted to hold a photographic film conveyed to the section at both sides thereof in accordance with the width of the film sheet which is characterized in that said processing operation is carried out by passing said photographic film through the processing agent which has been atomized by said atomizing means in said processing section the width of which has been adjusted in accordance with the width of photographic film.

The nature, principle and utility of the invention will become more apparent from the following detailed description when read in conjunction with the accompanying drawings.

DESCRIPTION OF THE PREFERRED EMBODIMENTS

Generally the following methods are conceivable in order to atomize the processing liquid. The explanation is given below with references to FIGS. 4A through 4D.

(A)

Figure 1:
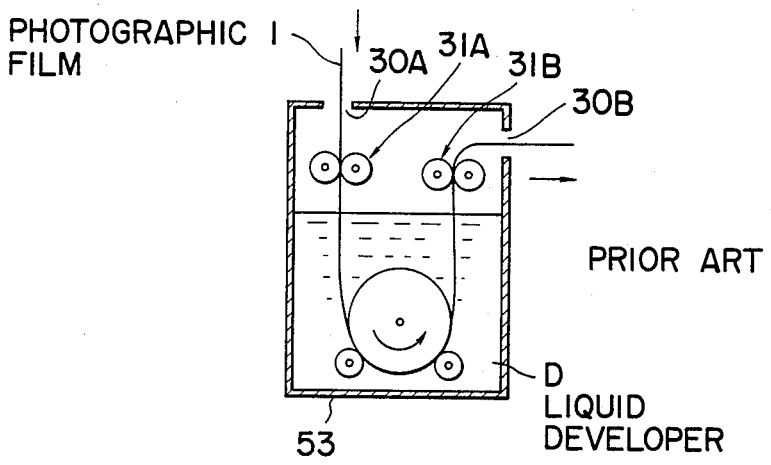
FIG. 1 is a cross sectional view to schematically show the structure of a photographic film processing system using a roller conveying processing method.
Figure 2A:
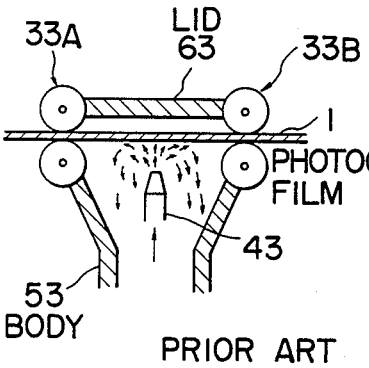
FIG. 2A is a cross sectional view to schematically show the structure of a processing system using a straight processing method.
Figure 2B:
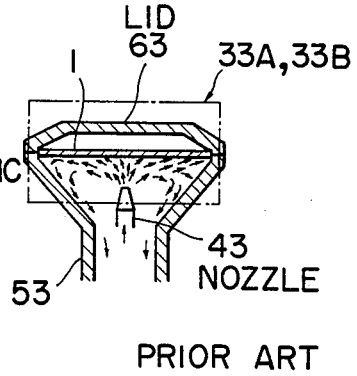
FIG. 2B is a side sectional view thereof.
Figure 3A:
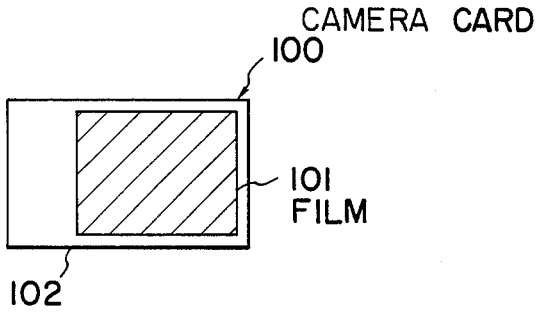
FIG. 3A is a plane view of a camera card.
Figure 3B:
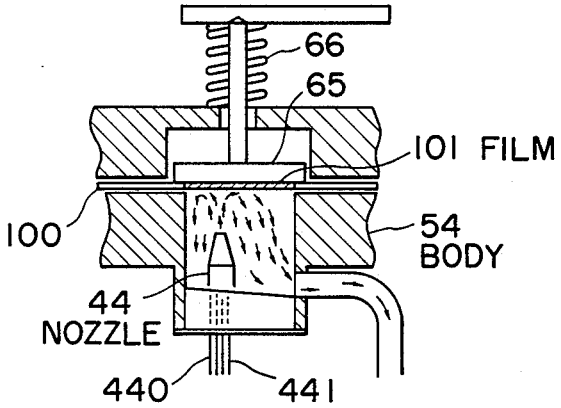
FIG. 3B is a cross sectional view to schematically show a processing system using a spray processing method.
Figure 4A:
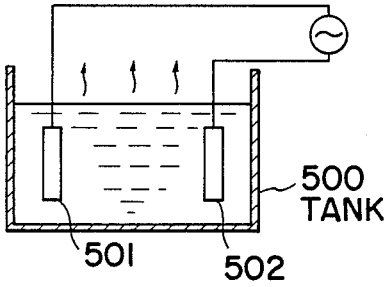
FIGS. 4A through 4D are views to explain general methods of atomization.

As shown in FIG. 4A, electrodes 501 and 502 are inserted in the processing liquid in a tank 500, and electric current is applied to the electrodes 501 and 502 so that the liquid is heated to be vaporized and atomized. Although this method needs only a simple device, since it needs to heat the processing liquid at a high temperature, it tends to deteriorate the processing capacity of the liquid.

(B)

Figure 4C:
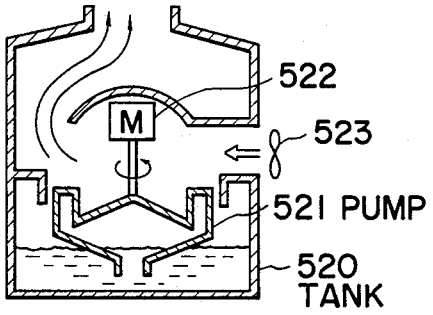
Figure 4B:
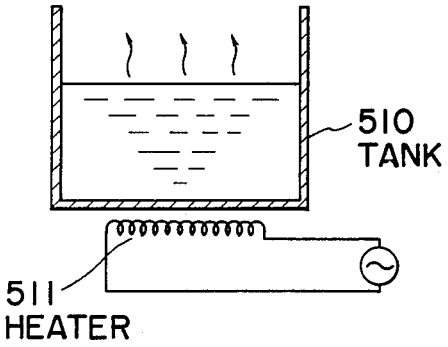

As shown in FIG. 4B, the liquid in a tank 510 is heated from outside by, for instance, a heater 511 for atomizing. Similarly to the above method (A), the structure is simple, but the processing agent should be heated at a high temperature to deteriorate the processing power thereof.

(C)

As shown in FIG. 4C, a motor 522 is internally mounted in a tank 520 to operate a pump 521 at a high speed in order to suck up the processing liquid, hurl the same onto the wall surfaces by using the centrifugal force to form fine drops, and forcibly send the drops with a fan 523. This method is free of the defects encountered in the above methods (A) and (B), but the system inevitably becomes large as it needs a motor and a pump and the shape of the tank becomes complicated.

(D)

Figure 4D:
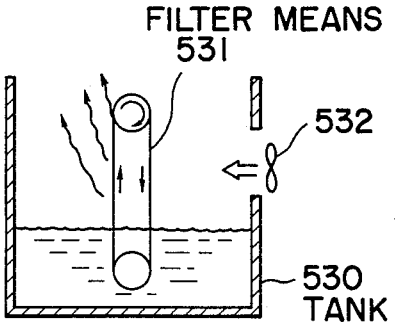

As shown in FIG. 4D, a pair of rollers mounted inside a tank 530 is wound with a filter means 531 made of, for instance, cloth. An end of the filter means 531 is immersed in the processing liquid and gradually rotated so as to be impregnated with the liquid. The air is passed through the filter means 531 with a fan 532 to atomize the impregnated processing liquid. This method is defective in that the sufficient amount of atomized agent cannot be obtained and the amount is difficult to be controlled.

In order to solve those problems, the present invention attempts to atomize the processing liquid by applying ultrasonic vibration with an ultrasonic vibrator. The ultrasonic vibrator may be a crystal oscillator, or an ultrasonic vibrator using piezo-electric property of lead zirconate titanate(PZT), polyvinylidene fluoride (PVDF), a ceramic composite material (PECM) or the like. The ultrasonic vibrator has a simple structure, and is small sized and yet can control the amount of atomization.

Figure 5A:
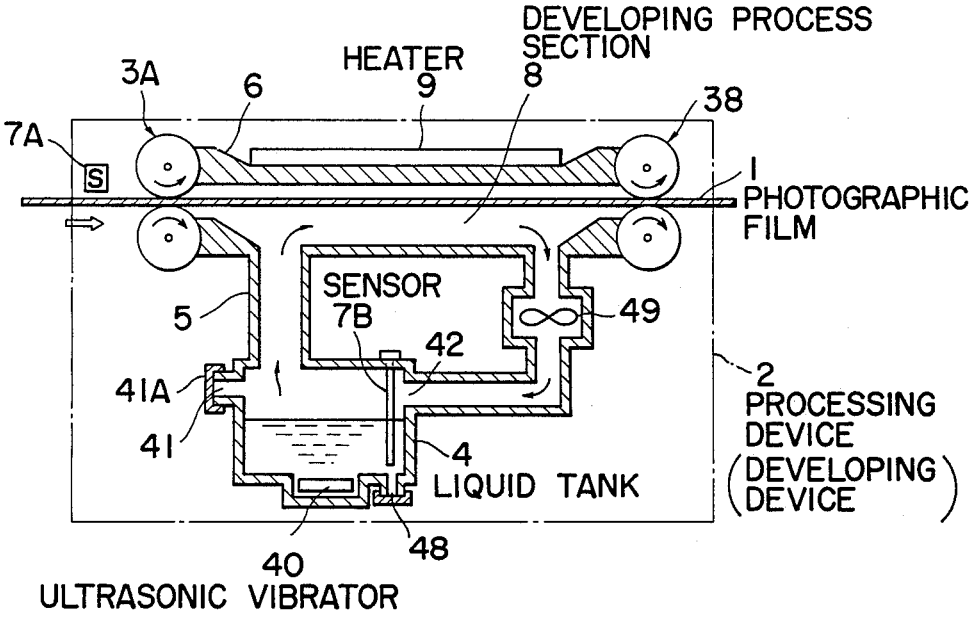
FIG. 5A is a cross sectional view to schematically show a processing system using a photographic film processing method according to this invention.
Figure 5B:
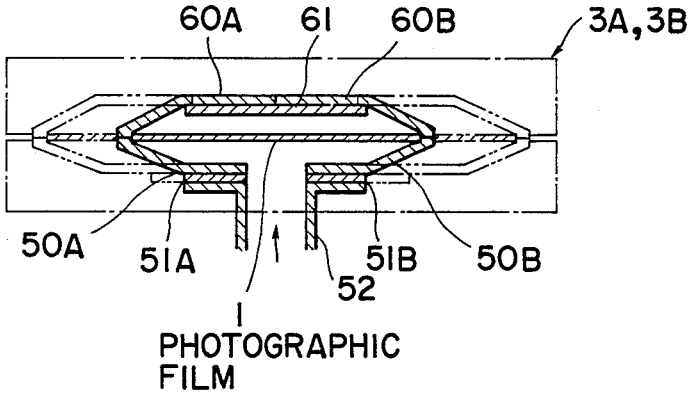
FIG. 5B is a side sectional view of the processing section thereof.

FIG. 5A shows a cross section of a photographic film processing device applying this invention method while FIG. 5B shows a side of the processing section thereof in section. Since this processing device 2 is often used similarly in the developing, fixing and washing processes, the explanation will be given below to an embodiment which is generally used in the developing process.

In FIG. 5A, the reference numeral 7A denotes a sensor which detects a photographic film 1 when it is conveyed to the developing device 2. Pairs of rollers 3A and 3B are provided respectively at an inlet and an outlet of a developing process section 8 to hold and convey the photographic film 1 therebetween. The developing process section 8 comprises a lower body 5 and an upper lid 6 and as shown in FIG. 5B, the lower body 5 comprises a plurality of elements 50A, 50B, 51A, 51B and 52 while the upper lid 6 comprises a plurality of elements 60A, 60B and 61. The elements 50A, 50B, 51A, 51B and 52 and 60A, 60B, 61 are advanced either automatically by a motor or manually to the position shown by broken line and receded to the position shown with solid line so that the width thereof may be adjusted while maintaining the air tightness therein in accordance with the size of the photographic film 1 conveyed. The photographic film 1 is slidably held on both sides widthwise with guides formed by the lower body 5 and the upper lid 6 to obtain air tight sealing and width thereof is adjusted in accordance with the size of the photographic film 1. The developing process sectoin 8 itself is sealed air tight at the inlet and the outlet with the pairs of rollers 3A and 3B. A liquid tank 4 is provided in the lower body 5 to contain the liquid developer which is poured from an inlet port 41 which is sealed with a cap 41A to prevent the atomized agent from leaking to outside except during the time of injection. The liquid tank 4 is provided in the bottom with a liquid exhausting port 48. The amount of the liquid developer in the tank 4 is detected with a sensor 7B at the liquid surface so as to control the depth of the liquid developer via a controller (not shown). An ultrasonic vibrator 40 of the aforementioned type is provided at the bottom of the liquid tank 4 to atomize the liquid developer and is driven by applying the voltage. The oscillating frequency of the ultrasonic vibrator 40 is changed by changing the voltage. A fan 49 is equipped on a cycling passage to forcibly feed the atomized developer into the developing process section 8 for developing the photographic film 1 and back to the liquid tank 4 via a port 42 for recycling. A heater 9 in a plate form is operatively provided on the upper lid 6 to maintain an optimal developing temperature at the conveying passage of the photographic film 1 and in the atomized developer. The heater 9 is detachable so that it can be removed when not necessary, for example, at the time of washing.

The explanation will now be given as to the developing process method with the developing device 2 having the above mentioned structure. In FIG. 5A, the photographic film 1 which has been conveyed in the direction shown with an arrow mark is conveyed for a developing process section by rotating a pair of rollers 3A when it is detected by the sensor 7A. The developing process section forms guides which is made airtight with the lower body 5 and the upper lid 6, and the width of the guides has been adjusted widthwide in accordance with the width of the advancing film to be processed, as shown in the side view shown in FIG. 5B. The film transmitted to the developing process section is conveyed further with the rollers 3B at the outlet along the guides. A suitable amount (or a suitable developing density) of the developer is atomized by the ultrasonic vibrator 40 in the liquid tank 4, and fed to the developing process section 8 with the fan 49 on the cycling passage. Since the conveying passages of the photographic film 1 and the atomized developer are maintained at an optimal developing temperature with the heater 9 above the upper lid 6 and both sides are sealed, only one side of the photographic film 1 (or the photo-sensitized side) is developed at the optimal temperature and the optimal developing density.

After the developing process which has processed films of predetermined amount, the developer of which the processing capacity has become low is exhausted from the liquid exhausting port 48. If the water is poured into the tank 4 and the electricity is applied to the ultrasonic vibrator 40 to generate the mist, the developing device 2 can be cleansed without dismantling it.

Figure 6:
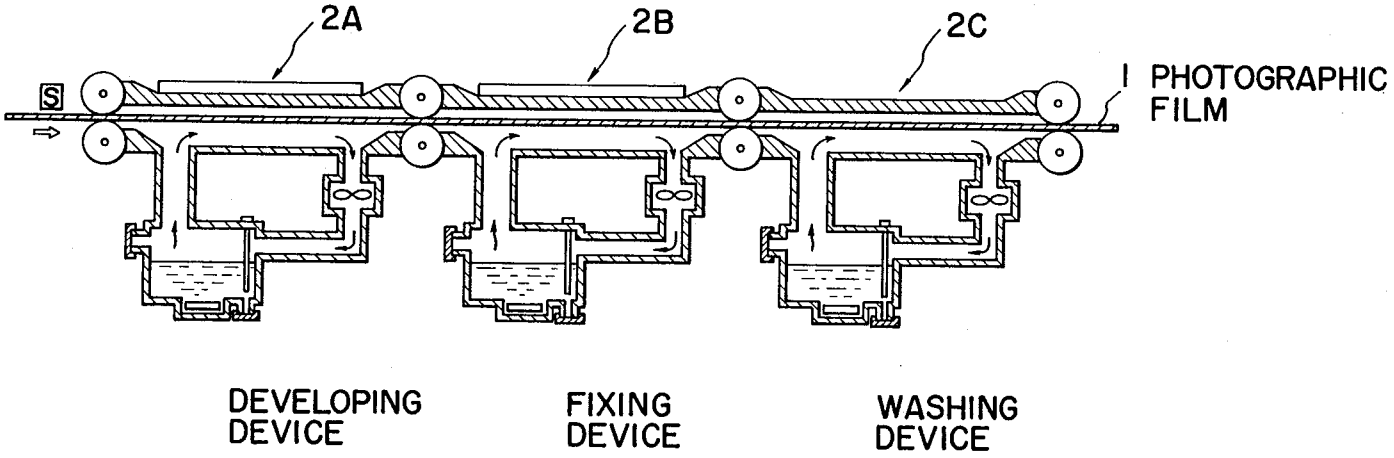
FIG. 6 is a sectional view to show another example of the application according to this invention.
Figure 7:
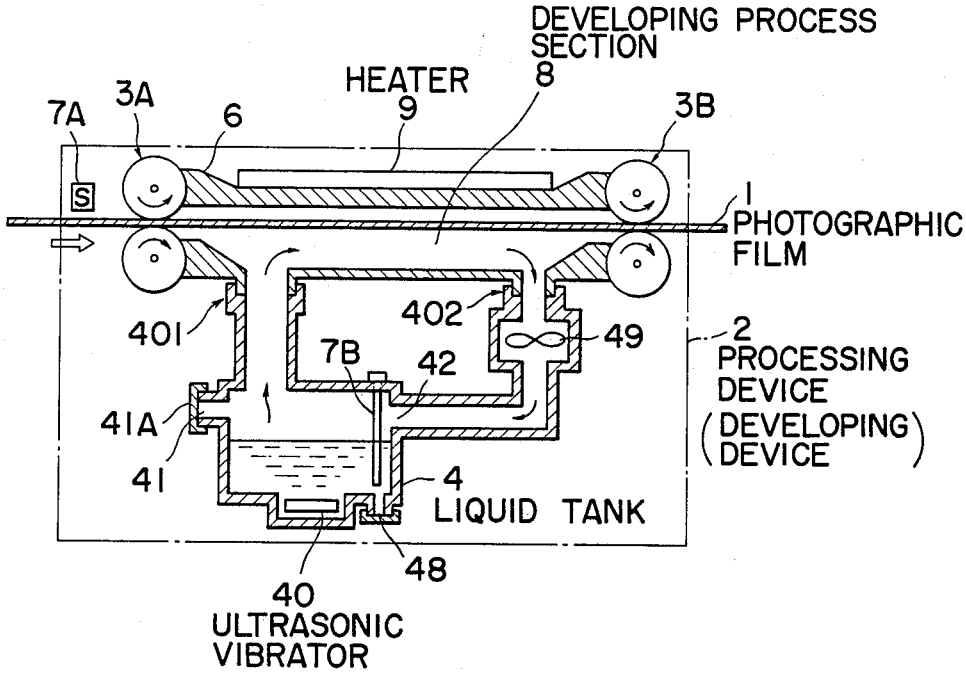
FIGS. 7 and 8 are a cross and a side sectional views to explain another embodiment of the processing device, respectively.

Although the above description has been given only as to the developing process in the above embodiment, the processing device is not limited to the developing process. As is obvious from the embodiment, if a certain amount of the liquid fixer is injected into the device, the device can be used as a fixing device without any change, and if a certain amount of water is poured, it can be used as a washing device. FIG. 6 shows an embodiment of a photographic film processing system which uses devices according to this invention connected in series as a developing device 2A, a fixing device 2B and a washing device 2C. In this processing system, the rollers at the outlet of the developing device 2A double as the inlet rollers of the fixing device 2B and the rollers at the outlet of the fixing device 2A double as the inlet rollers of the washing device 2C. If the temperature at the washing device 2C need not be adjusted, the heater 9 shown in the figure may be omitted.

Figure 8:
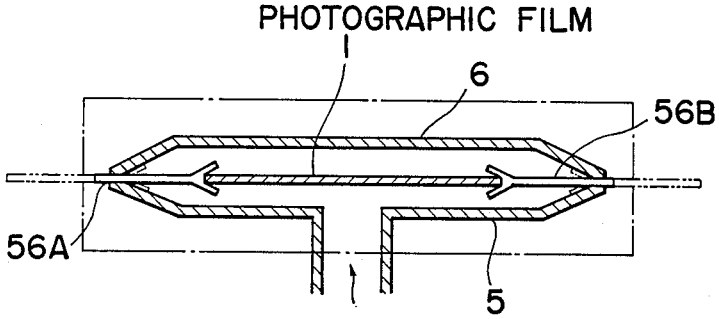

In the embodiment in the foregoing, the developing process section 8 comprises a lower body and an upper lid, the body and the lid each comprising plural elements 50A, 50B, 51A, 51B and 52 and 60A, 60B and 61 respectively. The elements are moved in accordane with the size of the advancing film sheet to have a corresponding width while maintaining the air tightness. However, as shown in FIG. 8, the upper lid 6 and the lower body 5 are provided with film guides 56A and 56B on the grooves thereof on both sides which can be slidably moved while maintaining the air tightness. Instead of moving the upper lid 6 and the lower body 5, the film guides 56A and 56B may be advanced to the position shown by broken lines or receded to the position shown by solid lines to hold and secure air-tightly the photographic film 1 therebetween.

Although the width of the developing processing section is adjusted in acordance with the width of the film sheet in the above statement, the section 8 may have a fixed width suitable for a particular film sheet width, and provided with joints 401 and 402 on the liquid tank 4 so that the section 8 is replaced with another section having a suitable width every time a photographic film of a different width is processed.

Although the developing device in the above embodiment is recycled, the processing liquid may be disposed after each use.

Accordingly, this invention provides a photographic processing system for deveopment, fixing and washing which is free of such defects as encountered in the prior art wherein the liquid processing agent required for development, fixing and washing is atomized and a photographic film is held and sealed on both sides thereof, if the general photographic film is processed so that only the photo-sensitized side of the film may be passed through the atomized agent.

Figure 9A:
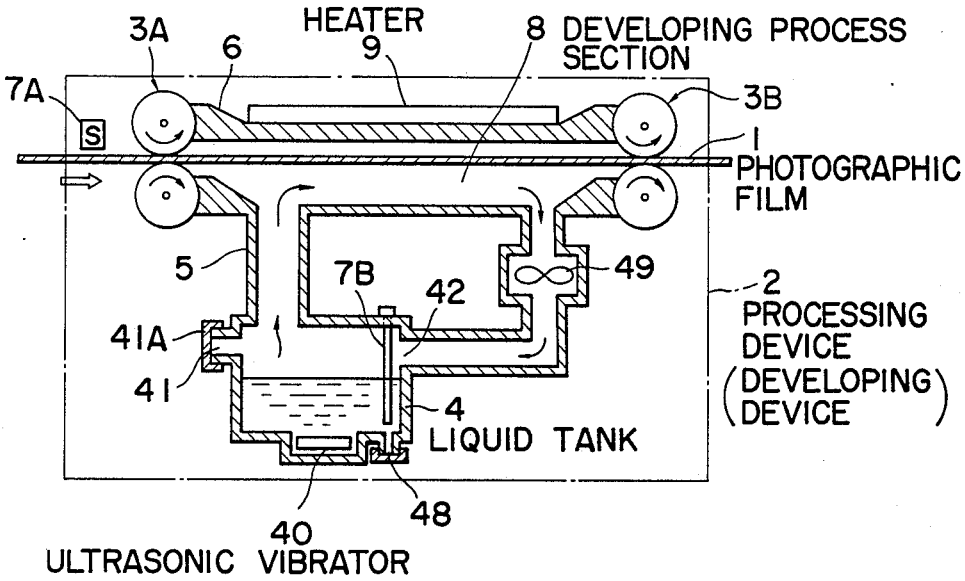
FIG. 9A is a cross sectional view to schematically show an another photographic film processing system according to this invention.
Figure 9B:
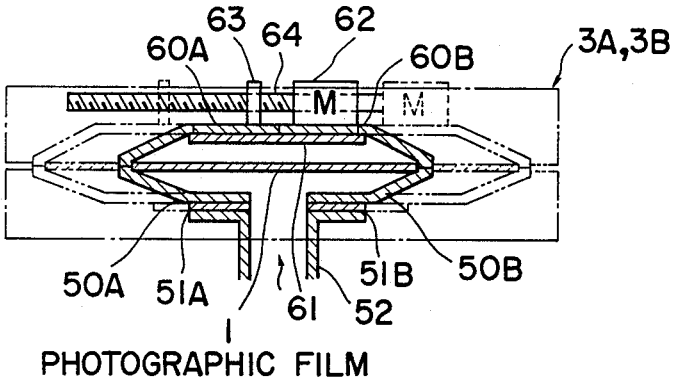
FIG. 9B is a side sectional view to show the processing section thereof.
Figure 9C:
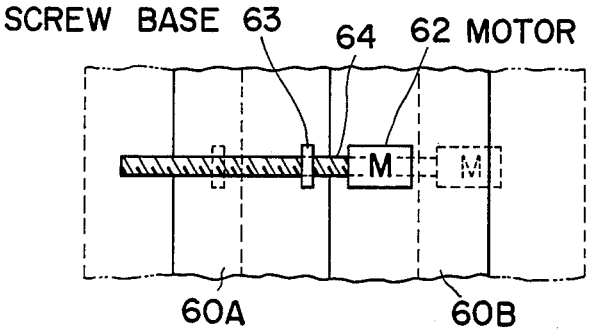
FIG. 9C is a view to show the mechanism for adjusting the width in accordance with the size of the photographic film.

FIG. 9A shows a cross section of this invention photographic film processing system, FIG. 9B a side view thereof and FIG. 9C a plane view of the mechanism which adjusts the width of the processing section in accordance with the width of the photographic film. Although the processing device 2 is used for developing, fixing and washing devices, the description below explains only the case where the device is used as a developing device.

In FIG. 9A, the reference numeral 7A denotes a sensor which detects the arrival of a photographic film 1 at the developing device 2. Pairs of rollers 3A and 3B are mounted both at a inlet and an outlet of the developing process section 8. The developing process section 8 comprises a main body 5 and an upper lid 6, the lower body 5 and the upper lid 6 in turn comprising plural elements 50A, 50B, 51A, 51B and 52 and 60A, 60B and 61 respectively. As shown in FIG. 9C, a motor 62 and a screw base 63 are operatively provided on the elements 60B and 60A respectively. The tapped hole penetrating through the screw base 63 is operatively mated with a screw 64 which is axially mounted on the motor 62. The rotation of the motor 62 in either the normal or the reverse direction causes the elements 50A, 50B, 51A, 51B and 52 and the elements 60A, 60B and 61 to move to the position shown by broken lines or return to the position shown by solid lines. When an operator manually operates an outside switch (not shown) depending on the size of a conveyed film sheet (e.g. whether the width thereof is 16 mm or 35 mm), the width is automatically adjusted by a suitable amount. The elements 50A, 50B, 51A, 51B and 52 and the elements 60A, 60B and 61 are moved in adjusting operation while maintaining the air tightness. The photographic film 1 therefore can be held and sealed on both sides thereof with the grooves formed by the main body 5 and the upper lid 6 in the width adjusted in accordance with the width of the film sheet. The developing process section 8 per se is sealed to maintain the air tightness with the pairs of rollers 3A and 3B at the inlet and the outlet thereof. The main body 5 is provided with a liquid tank 4 to contain the processing liquid the amount of which is detected by a sensor 7B to control the surface height via a controller. The liquid tank 4 is equipped on the bottom thereof with an ultrasonic vibrator 40 for atomizing the developing liquid. A fan 49 operatively provided on the cycling passage feeds the atomized agent to the developing process section 8 for developing the photographic film 1 and sucks back the same to the liquid tank 4 via a port 42 for recycling. A heater 9 in the form of a plate is operatively provided above the upper lid 6 in a detachable manner so that it may be removed from the processing system when it is not necessary, e.g. at the time of washing.

The explanation will not be given to the process of the development by means of a developing device 2 having the aforementioned structure. The photographic film 1 which has been conveyed in the direction shown by an arrow in FIG. 9A is detected by the sensor 7A, and held between a pair of rollers 3A at the inlet. The photographic film 1 is sealed slidably on both sides thereof with grooves formed by the lower body 5 and the lid 6 having the width which has been adjusted in accordance with the film sheet width, and conveyed toward the outlet with the rollers 3B. The liquid agent is atomized at an optimal density (or an optimal amount) by the ultrasonic vibrator 40 provided at the liquid tank 4, and forcibly fed to the developing process section 8 with the fan 49 on the cycling passage. Since the temperature of the cycling passage and the atomized agent is maintained at the optimal developing temperature and both sides are sealed, the photographic film 1 may be developed only on one side (or only the photo-sensitized side) at the optimal temperature and at the optimal density.

After the developing process, the liquid developer is exhausted from a port (not shown). If a certain amount of water is poured into the developing device and the electricity is applied to the ultrasonic vibrator 40 to generate the steam, the device can be cleansed easily without dismantling it.

Figure 10A:
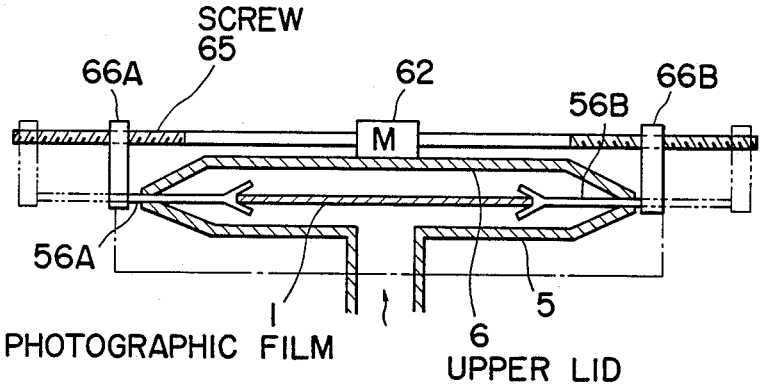
FIGS. 10A and 10B are respectively structural views to show still another embodiment of the processing device according to this invention.
Figure 10B:
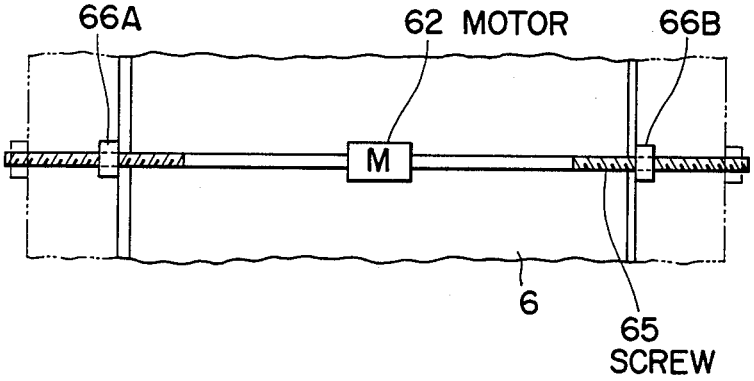

In the above embodiment, the developing process section 8 comprises the main body 5 and the upper lid 6, the body 5 and the lid 6 in turn comprising plural elements 50A, 50B, 51A, 51B and 52 and 60A, 60B and 61 respectively. These elements are moved while maintaining the air tightness to adjust the width in accordance with the width of the photographic film 1 in the above embodiment. Instead, film guides 56A and 56B may be provided in the grooves formed by the upper lid 6 and the lower body 5 as shown in FIG. 10A, a motor 62 may be provided on the upper surface of the lid 6, and screw bases 66A and 66B may be operatively provided on side ends of the film guides 56A and 56B respectively as shown in FIG. 10B. Tapped holes penetrating through these bases 66A and 66B are operatively mated with a screw 65 which is axially mounted on the motor 62. The rotation of the motor 62 in either the normal or the reverse direction causes the film guides 56A and 56B to move to the position shown by broken lines or return to the position shown by solid lines so that the film guides 56A and 56B may be moved in accordance with the width of the film sheet to seal and secure the film sheet on both sides thereof.

According to this invention photographic film processing method and device, the processing agent is atomized with an ultrasonic vibrator into very fine particles, the density (or the amount of the atomized agent) is adjusted to an optimal level simply by controlling the applied electric voltage, and the section and the atomized agent are maintained at an optimal temperature by a heater. The density of the finished products can therefore be easily controlled to obtain uniform finish. Since only one side (or the photo-sensitized side) of a photographic film is passed through the atomized processing agent in the width adjusted to the corresponding width of the film sheet, no agent is wasted, thereby reducing the consumption of the processing agent. Further, the photographic films need not be dried every time to enhance the speed of process. Since this invention device has less components and can be cleaned without dismantling, less damage is inflicted on the film surfaces and almost no maintenance work is required to thereby reduce the burden on workers.

It should be understood that many modifications and adaptations of the invention will become apparent to those skilled in the art and it is intended to encompass such obvious modifications and changes in the scope of the claims appended hereto.

What is claimed is:

1. A photographic film processing method for processing with liquid processing agents which comprises atomizing the liquid processing agent by an ultrasonic vibrator having a variable oscillating frequency, and processing said photographic film by passing the photographic film through said atomized agent, whereby the finished density of the photographic film is controlled by varying said oscillating frequency.

2. The photographic film processing method as claimed in claim 1 wherein the photographic film is sealed on both sides thereof in passing the photographic film sheet through said atomized agent, so that only the photo-sensitized side of said photographic film is processed.

3. A photographic film processing device for processing photographic film with a liquid processing agent which includes an ultrasonic vibrator having a variable oscillating frequency for atomizing the liquid processing agent, and a means for guiding the atomized processing agent onto the photo-sensitive surface of the photographic film, whereby the finished density of the photographic film is controlled by varying the oscillating frequency.

4. The photographic film processing device as claimed in claim 3 wherein said atomized processing agent which has been used for processing photographic films is recycled to said means for atomizing the liquid agent.

5. A photographic film processing device which conducts developing, fixing and washing processes continuously wherein that processing units comprising a means for atomizing liquid processing agents and a guide means for guiding said atomized processing agents onto the photo-sensitized surface of a photographic film are arranged in series to accomodate necessary processing steps and said photographic film sheet is made to pass through said serially connected units for continuous process of said steps.

6. The photographic film processing device as claimed in claim 5 wherein said processing units are adapted to recycle atomized processing agent which has been used for processing said photographic film to said atomizing means.

7. The photographic film processing device as claimed in claim 5 wherein said atomizing means is an ultrasonic vibrator.

8. The photographic film processing device as claimed in claim 5 wherein applied voltage to said ultrasonic vibrator is changed so as to change the oscillating frequency thereby to change amount of said atomized agent and adjust the finished density of said photographic films.

9. A photographic film processing device for developing, fixing and washing steps including a means for atomizing a liquid processing agent and a processing section which is adapted to hold a photographic film conveyed to the section at both sides thereof in accordance with the width of the photographic film wherein that said processing operation is carried out by passing said photographic film through the processing agent which has been atomized by said atomizing means in said processing section the width of which has been adjusted in accordance with the width of said photographic film.

10. The photographic film processing device as claimed in claim 9 wherein said processing section can be adjusted in width so as to seal said photographic film at both sides thereof, and only the photo-sensitized side of said photographic film is passed through and subjected to said atomized processing agent which has been atomized by said atomizing means.

11. The photographic film processing device as claimed in claim 9 wherein said processing section includes members for sealing said photographic film on both sides thereof and members for slidably moving said members for sealing, and only the photo-sensitized side of said photographic film is made to pass through and is subjected to said processing agent which has been atomized by said atomizing means.

12. The photographic film processing device as claimed in claim 9 wherein said atomizing means is an ultrasonic vibrator.

13. The photographic film processing device as claimed in claim 12 wherein applied voltage to said ultrasonic vibrator is changed so as to change the oscillating frequency thereby to change amount of said atomized agent and adjust the finished density of said photographic films.

* * * * *